United States Patent [19]

Dale

[11] Patent Number: 4,823,718

[45] Date of Patent: Apr. 25, 1989

[54] SPIN TACK CONTROL

[76] Inventor: Harry L. Dale, 537 Dove Creek Cir., Grapevine, Tex. 76051

[21] Appl. No.: 121,038

[22] Filed: Nov. 16, 1987

[51] Int. Cl.[4] ..... B63H 9/10

[52] U.S. Cl. ..... 114/113; 114/102; 114/106; 114/107; 114/111

[58] Field of Search ..... 114/102–108, 114/111, 113, 204, 89, 90

[56] References Cited

U.S. PATENT DOCUMENTS

| | | | |
|---|---|---|---|
| 170,966 | 12/1875 | Rankin | 114/113 |
| 641,016 | 1/1900 | Hupfel | 114/113 |
| 4,671,200 | 6/1987 | Nakamura | 114/107 |

*Primary Examiner*—Joseph F. Peters, Jr.
*Assistant Examiner*—Clifford T. Bartz
*Attorney, Agent, or Firm*—James C. Fails; Arthur F. Zobal

[57] ABSTRACT

A device which allows hanking characterized by improved apparatus in a boat with a conventional mast, a plurality of lines and accessories, roller furling jib headsail, comprising a large diameter ring disposed about the furling jib system and furled said headsail wiht rollers that allow said ring to move vertically along said furling jib system and headsail without damage to said headsail for most efficiently controlling a cruising spinnaker sail in a vertical plane. Also disclosed are details of the rings and rollers thereon.

7 Claims, 3 Drawing Sheets

SPIN TACK CONTROL

FIELD OF THE INVENTION

This invention relates to controls for sailing boats, ships and the like. More particularly, this invention relates to an improvement in apparatus for controlling the tack of a cruising spinnaker in a vertical plane when a roller furling jib headsail is being used on a sailboat.

BACKGROUND OF THE INVENTION

The prior art has seen a wide variety of control apparatus for controlling the sails in a sailboat for most efficient sailing of the boat. It is recognized that sailing craft are widely differing in sophistication, length and the controls thereon. This invention is particularly useful in the sailboats of the 21 foot to 50 foot in length variety and having the usual lines for controlling the sails, masts for supporting the force of the sails and the like. It has relatively little applicability for the new movable sails on surfboards or for craft that do not employ the lines and accessories on the usual type sailboat.

Even on such sailboats, however, the prior art has seen the development of a wide variety of improved approaches. One of the improved approaches is the use of a furling jib system for taking up a headsail. Such a furling jib system may be used to furl, or take up, a headsail by being rotated and move the headsail laterally instead of having to move it vertically. When this is done, as will be appreciated, the furling jib system thereafter has the headsail wrapped around it such that conventional approach to moving of lines or conventional approaches to connecting the tack of a spinnaker with the forestay, or furling jib system, cannot be employed to allow vertical movement since the headsail wrapped around the furling jib system would be damaged. It is in this environment that the apparatus of this invention has applicability.

A search of the prior art reveals the following patents.

U.S. Pat. No. 12,506 shows a ship's mast hoops in which roller or rollers are interposed as a part of a mast hoop to reduce the friction of movement along a mast.

U.S. Pat. No. 85,234 shows a mast hoop in which spheres are rotatably mounted on a metallic part B of a mast hoop that is otherwise wooden for reduced friction for movement along the mast.

U.S. Pat. No. 93,303 shows a ring with a plurality of rollers disposed thereon for reducing friction for movement along a mast. Similarly, U.S. Pat. No. 387,767 discloses a ring 10 having rollers 15 loosely thereon for reducing friction of movement along a mast.

From the foregoing it can be seen that the prior art structures do not provide an improvement that will allow vertical movement of a tack of a spinnaker along a furling jib system with a headsail wrapped around it. Neither does the prior art provide any suggestion to incorporate such an improvement into modern sailing apparatus.

SUMMARY OF THE INVENTION

Accordingly, it is an object of this invention to provide an improvement in apparatus for controlling the tack of a cruising spinnaker in a vertical plane for most efficient sailing of a boat that incorporates the usual accoutrements and incorporates improvements for allowing controlling the vertical height of the tack of the spinnaker even with a furling jib system having a headsail rolled thereon.

It is a specific object of this invention to provide an improvement in the apparatus for controlling the cruising spinnaker in a vertical plane for the most efficient sailing of a boat that includes the usual accoutrements and allows vertical movement along the furling jib system even with the headsail wrapped around it by simply playing out the line connected with the tack of the spinnaker.

These and other objects will become apparent from the descriptive matter hereinafter, particularly when taken into conjunction with the appended drawings.

In accordance with this invention, there is provided an improvement in the apparatus for controlling the tack of a cruising spinnaker for the most efficient sailing of a boat that includes a mast, conventional lines, and accessories for controlling the sails and the like, a roller furling jib system, and a headsail that can be taken up or rolled around the furling jib system responsive to torque imparted to the furling jib sail; the improvement being characterized by a ring encompassing the furling jib system and the headsail and connected with the tack of a spinnaker that is to be controlled, the ring having a larger diameter than the furling jib system and the encompassing headsail, the ring having a means for emplacement around the furling jib system and headsail and means for attaching the ring with the tack of the spinnaker being controlled and the line for controlling the vertical height of the tack of the spinnaker; and a plurality of rollers rotatably mounted on the rings such that the ring can be moved vertically along the furling jib system and the encompassing headsail without damage to the headsail.

DESCRIPTION OF PREFERRED EMBODIMENTS

Figure 2:
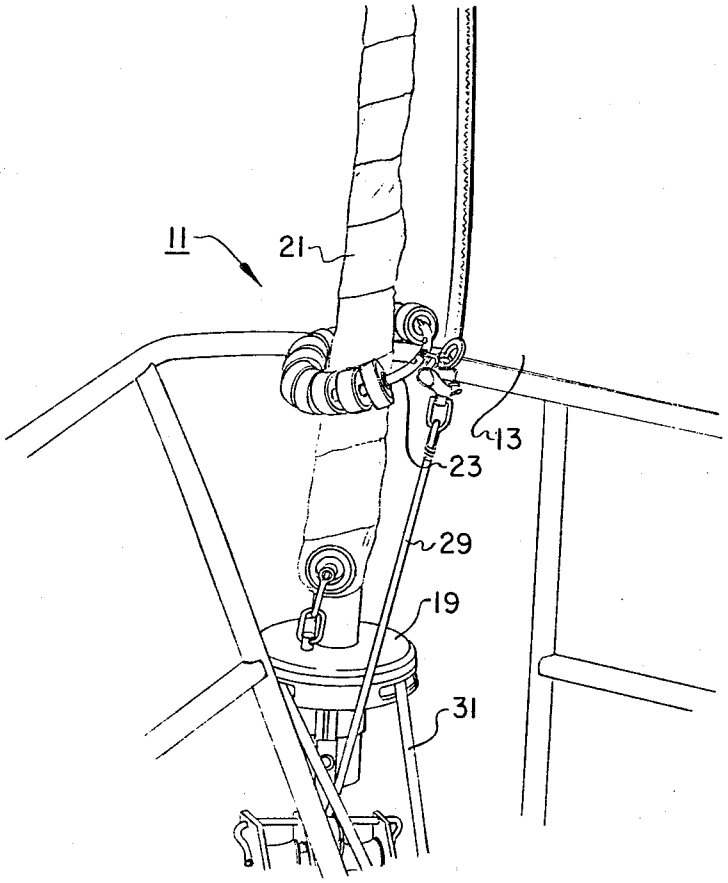
FIG. 2 is a partial side elevational view of the tack of the spinnaker connected low, as at the top of the bow pulpit, for sailing with the wind.

Referring to FIGS. 1–5, there are illustrated various aspects of the improved apparatus 11 of this invention. Specifically, this invention includes improvement in apparatus for controlling the tack of a cruising spinnaker 13 in a vertical plane for most efficient sailing of a boat 15, FIG. 4. The boat 15 includes at least one mast 17; a plurality of conventional lines and accessories for controlling the sails; a roller furling jib 19, FIG. 2 and a headsail 21, which may be rolled around the furling jib system 19, it taken in. This apparatus includes an improvement comprising a ring 23, FIGS. 1–3 and 5 encompassing the furling jib system and headsail and when headsail is wrapped around the furling jib system interiorly of the ring. The ring 23 has a larger diameter than the furling jib system and the headsail so it can encompass them and be moved vertically therealong without damage to the headsail.

To accomplish this latter point, a plurality of rollers 25 are rotatably mounted on the ring 23 such that the ring can be moved vertically along the furling jib system and the head sail with the headsail wrapped around the furling jib system without damage to the headsail.

As illustrated, it is preferred that the rollers be disposed more than half way around the ring 23 and on the side opposite the means for connecting the ring to the tack of the spinnaker and the line controlling the vertical height of the tack of the spinnaker.

The cruising spinnaker is a large sail for increasing the speed of a boat sailing before the wind, or off the wind direction. Specifically, the spinnakers are large, lightweight sails shaped like a cone, cut vertically. It was developed for racing but now is found on many small sailboats to improve their speed and performance. It is usually used only for sailing downwind when the jib loses its function of funneling the wind into the mainsail and flaps uselessly. At this point, the spinnaker's vast size and ability to face right angles to the wind make it a far more effective sail. Modern spinnaker cloth is lightweight nylon and comes in many bright colors that produce a striking effect when a weekend racing fleet sails its downwind leg. As with the jib and mainsail, the spinnaker has its head, tack and clew, plus its own halyard. It is hoisted by the head to a point at or near the top of the mast. Because it is bulky, most sailers find it easier to control if raised out of a bag or box.

The boat 15 may comprise any of the sailing vessels that employ their own accessories such as cleats, cam-action cleats, chocks, winches and the like.

There are many other items or hardware aboard a sailboat that are called fittings, or accessories. They come in a wide variety of shapes, sizes and costs and in materials that yachtsman generally refer to as galvanized (also known as less expensive), bronze, plastic, or chrome (most expensive). Starting at the bow, we find the headstay fitting and its turnbuckle which tightly secures the headstay. The painter (a short line which ties the boat to a pier) and/or the mooring lines lead through the bow chock. On the foredeck lies a cleat for painter or mooring lines Near the mast, the jib sheet is attached to the clew by means of a shackle which snaps shut. Around the mast at deck level are a cluster of fittings such as halyard cleats, cleats for the main down hull, spinnaker guy, and topping lift. Also, here is a gooseneck fitting that secures the boom to the mast. Another item, principally for racing craft is the bomm vang, a detachable fitting that runs from the underside of the boom to the deck. Its purpose is to hold the boom and mainsail down against actions of wind and wave when sailing before the wind. A wide variety of fittings are well known and are described in various books such as "Sailing," Bill Wallace, Golden Press, copyright 1960 and 1966 and a book entitled "Sailing for Beginners," Moulton H. Farnham, Editor, Boating Magazine, copyright 1967, the Macmillan Company, Toronto and Ontario, Canada.

The mast may be a smaller mast that can be installed, or inserted in smaller sailboats to facilitate transportation or it may be large masts that are made with the boat, just forward of the center board, for example, to carry the rigging such as the sails and the like.

The roller furling jib system 19 is a relatively new piece of sailing equipment in which the rotatable furling jib system can be turned as by pulling on the rope 31, FIG. 2, to effect rotation of the jib system and move a sail, such as a headsail, laterally such that it encompasses the furling jib system and is maintained thereon The sails are usually formed of non-stretchable material such as Dacron or the like that resists mildew. It is this kind of sail that is best for the head sail 21, since it can be rolled onto the furling jib system and still resist mildew and other forms of decay that might rot cotton or the like.

The ring 23 of this invention may be formed of the material conventionally employed in this art. For example, it may be formed of brass or stainless steel or the like for high quality. The ends of the ring at the cut will be discontinuous even though it is recognized that a pure ring would not be discontinuous. At the cut, it is preferable to employ a stainless steel insert having attached thereto the attachment shackle 27 which may be of stainless steel or the like for attaching to lines or to the tack of the spinnaker or both. The attachment shackle 27 is preferably hingedly mounted, or connected by a pin shaft to the stainless steel insert. The stainless steel insert is, in turn, inserted into the respective ends of the ring 23 and held in place by suitable means such as bolts or screws 31, 33. This allows the opening and closing of the ring for its installation. If desired, the ring can be hingedly connected at its midpoint opposite the shackle 27 to facilitate opening and closure for installation and removal. The approximate ring sizes will depend upon the diameter of the roller furling jib and the particular sailing vessel on which it is employed. Approximate rings sizes on the order of 4 inches in diameter, 6 inches in diameter, 10 inches in diameter should provide adequate rings for any of the vessels from 21 to 50 feet in length. The respective ring sizes will take respective diameter rollers as follows: The 4 inch ring will take about 1½ inch outside diameter (o.d.) rollers, the 6 inch ring will take about 2 inch rollers and the 10 inch ring will take about 3 inch rollers. This will allow the ring to be moved upwardly and downwardly along the headsail without appreciable friction and without damage to the headsail even though it is wrapped around the roller furling system.

The rollers 25 are formed of thermoplastic material like ABS (acrylonitrile butadiene styrene copolymer) or even PVC (polyvinyl chloride). If desired, the rollers 25 could have an outer ring of thermoplastic material that is fitted to a roller center that is allowed to roll as by bearings, inserts or the like about the ring at its position thereon. It has been found that no bearings or bushings are necessary if thermoplastic material having the right lubricity is employed.

Preferably, there is a sufficient plurality of rollers so they can be disposed more than half way around the ring and are disposed on the opposite side of the ring from the attachment shackle 27. In this way, they prevent damage to the headsail during change in elevation of the attachment of the tack and spinnaker sail.

Figure 6:
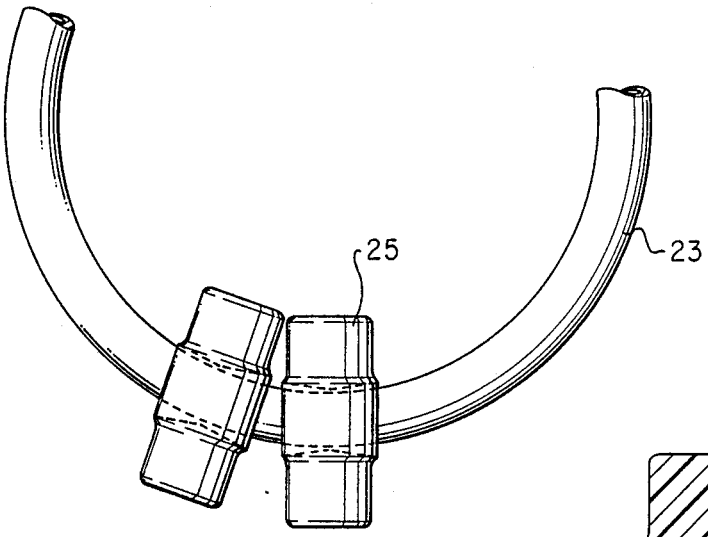
FIG. 6 is a front elevational view of the ring 23 with the rollers 25 thereon with their frusto-conical shaped central aperture illustrated in dash lines.
Figure 7:
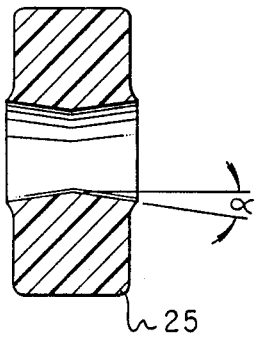
FIG. 7 is a cross-sectional view of a roller showing the frusto-conical central axis with the angle alpha illustrated, alpha being the angle the frusto-conical aperture walls make with respect to its own central longitudinal axis.

The rollers 25 are constrained to a certain sector of the ring opposite the shackle 27 by suitable pins inserted through the ring 23. The rollers have a frusto-conical control aperture that has an angle alpha, FIG. 7, which allows the aperture to closely conform to the ring such that the rollers will not move past the pins, simultaneously constraining the rollers to roll in the sector in which they are located, or at a given roller position. The frusto-conical central aperture can be molded or machined with a conical bit. In any event they will ultimately look like the roller 25 illustrated in FIGS. 6 and 7.

When the ring is made of stainless steel, it is preferable to employ #316 stainless steel. When the rollers are formed of thermoplastic material it is preferable to employ thermoplastic material having resistance to ultraviolet rays of the sun, as well as to the wind and salt water, so that they can be employed in marine environments.

In operation, it is desirable to position the tack of a cruising spinnaker as close to the center line of the boat at the location of the forestay. This can be accomplished by use of the spin tack which rolls up or down on the furled headsail/forestay; and provides a method of attachment of the tack of the cruising spinnaker, thus providing control of the spinnaker tack up or down on the center line of the boat. This allows the boat to sail more efficiently, on or off wind. The proper position of the spinnaker tack, when sailing close to windward, is center line of the boat and at a height approximately the top of the bow pulpit. The spinnaker sheet, attached to the clew, would be adjusted in until luffing and fluttering was controlled. This is referred to as being closed falled.

As the boat is sailed more off the wind, spinnaker sheet must be eased. This allows the clew to rise high and forward relative to the boat deck. The sheet is eased until the luff begins to curl. At that time the apparatus of this invention is allowed to rise on the furled headsail/-forestay 21, FIG. 2, until it is approximately the same height as the clew. This is referred to as easing the tack control line.

Figure 5:
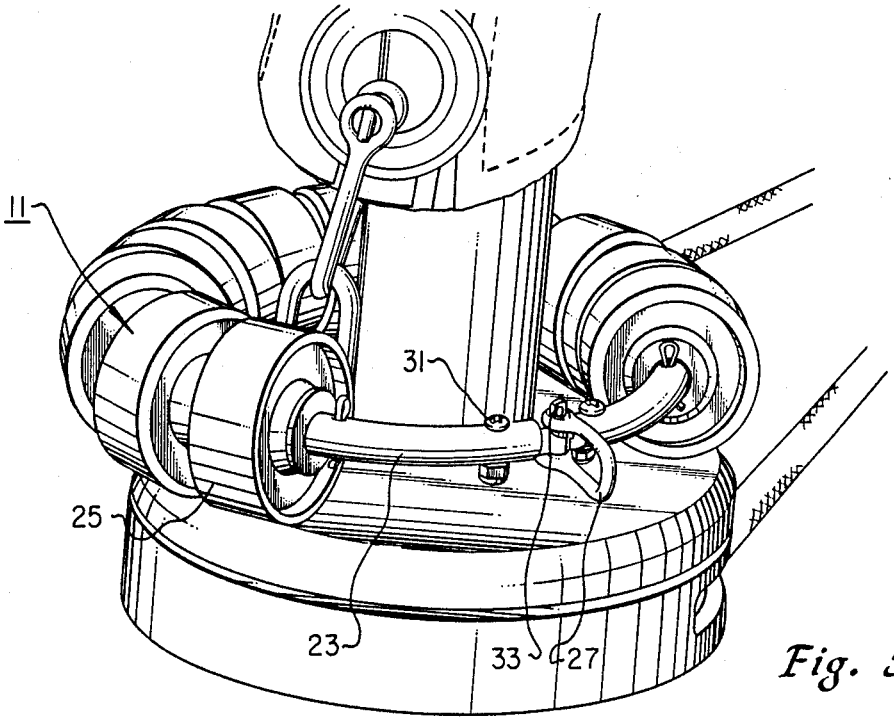
FIG. 5 is an isometric closeup view of the improvement in accordance with one embodiment of this invention, with the ring and rollers at the bottom of a furling jib system.

This procedure of spinnaker set adjustment is repeated as the boat is sailed further off the wind and, in fact, can be sailed with the wind directly abaft the boat if the mainsail is gybed, thus creating a so-called "wing and wing" sail configuration. One of the advantages of the invention is that when the ring has been employed, it may be left in place, as illustrated in FIG. 5 at the bottom of the furling jib system such that the headsail can be rolled thereonto or therefrom as desired.

Two control lines are needed for both vertical and horizontal control. Horizontal control is desirable when sailing on a down wind direction and one desired to adjust the spinnaker out from the center line of the boat in order to capture maximum wind velocity which is not disturbed by the main sail. Previous patents are not designed for these adjustments while not damaging a furled headsail. Furthermore, roller furling sails and cruising spinnakers were only lately developed.

The specially designed rollers prevent said damage while allowing vertical and horizontal adjustment to the spinnaker. The specially designed rollers center hole formed in a taper shape, allows the rollers to form a circle on the ring while rotating.

Figure 1:
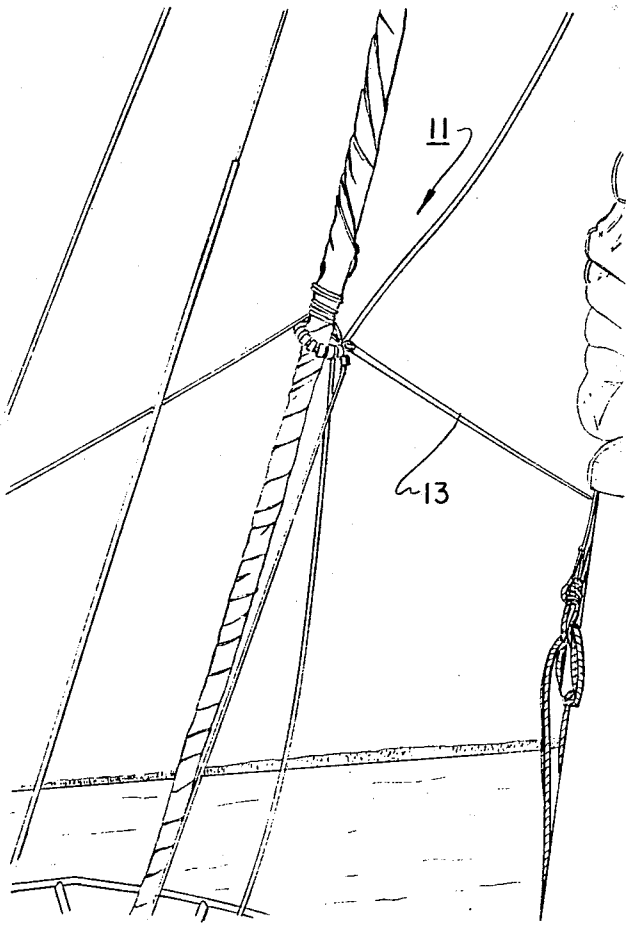
FIG. 1 is a partial side elevational view illustrating the controlling of the tack of a spinnaker at an elevation well above the top of the forecastle, as in off-wind sailing.

On the other hand, as illustrated in FIG. 1, when a spinnaker is first played out, it is allowed to rise to the height desired, as illustrated in FIG. 1 where it is relatively high and up to the limit by the lines. On the other hand, the line 29, FIG. 2, to the tack of the spinnaker can be brought in until the spinnaker is to a low location, as illustrated in FIG. 2. Through the improved apparatus of this invention, the rollers 25 will allow the ring 23 and the attached tack of the spinnaker to be played out to any desired height for most efficient sailing on or off the wind.

Figure 3:
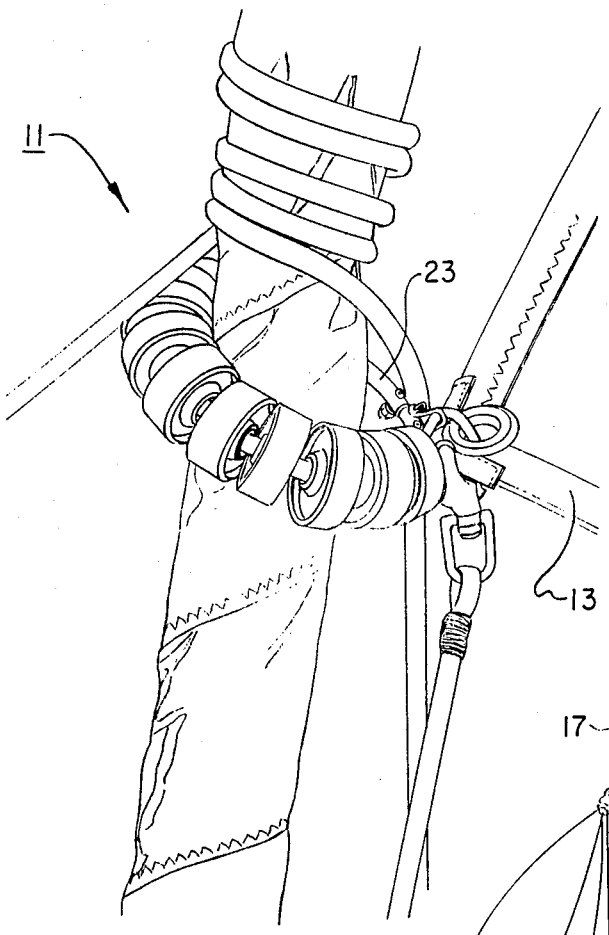
FIG. 3 is a partial closeup view, showing the connection of the tack of the spinnaker with the furling jib sail and showing clearly the improvement of this invention for allowing movement vertically therealong without damage to the furled sail wrapped around the furling jib system.
Figure 4:
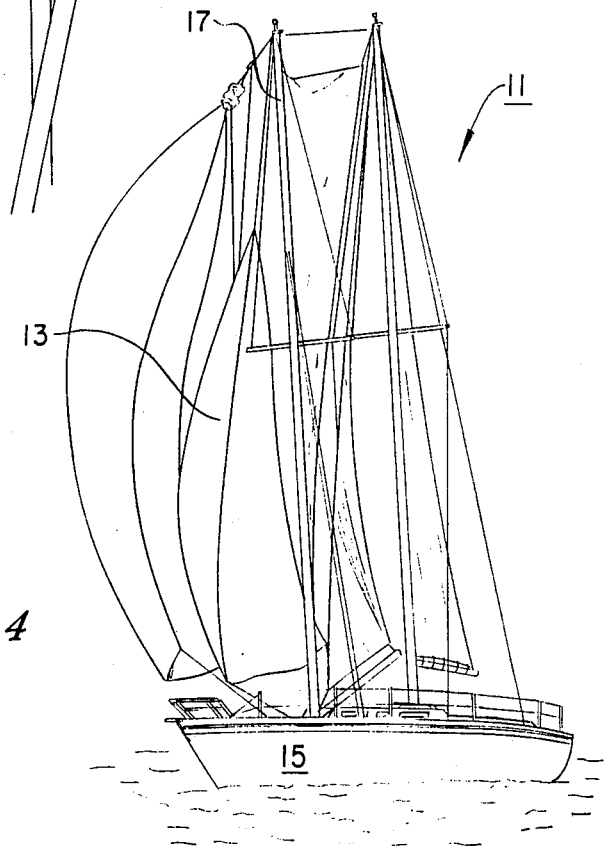
FIG. 4 is a side elevational view of a sailing craft with mast and sails illustrated.

FIG. 3 illustrates a closeup of the embodiment of FIG. 1 in which the ring and rollers have allowed the tack of the spinnaker 13 to be played out to near the maximum allowed by the attached lines.

The ring 23 of this invention must have a method of opening and closing which allows its installation and its removal without necessity for removing the furling jib gear, sail and forestay. The three ring diameter size as delineated hereinbefore will allow fitting furling jibs and headsails of any boat from 21 to 50 feet in length, although this could be larger if the diameter of the furled headsail was larger.

From the foregoing, it can be seen that this invention achieves the objects delineated hereinbefore and obviates the prior art.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. In an apparatus for controlling the tack of a cruising spinnaker in a vertical plane when a roller furling headsail is being used for most efficient sailing of a boat that includes:

a. a mast;

b. a plurality accessories for controlling the sails on the boat;

c. a headsail;

d. a roller furling jib system to which is connected said headsail such that said headsail becomes wrapped around said furling jib system when said furling jib system is rotated for taking up said headsail, the improvement comprising:

e. a ring encompassing said furling jib system and said headsail and having a larger diameter than said furling jib system and said encompassing headsail; said ring having a means for emplacement around said furling jib system and said headsail and means for attaching said ring to the tack of the spinnaker and to a line controlling the vertical height of said tack of the spinnaker;

f. a plurality of rollers rotatably mounted on said ring and disposed more than half way around said ring on at least the side of said ring opposite said means for attaching said ring with the tack of said spinnaker and the line connected therewith such that said ring can traverse vertically along said furling jib system and said rolled headsail about the furling jib system without damage to said headsail.

2. The improved apparatus of claim 1 wherein said ring comprises a metallic ring that has as said means for emplacement its ends adapted to be spread apart and an insert inserted thereinto, said insert having means for connecting an attachment shackle for serving as a part of said means for attaching said spinnaker and the line controlling the vertical height of said tack of said spinnaker; wherein said insert is inserted into the ends of said ring and a screw is put through apertures therethrough so as to hold laterally said insert within said ends of said ring.

3. The apparatus of claim 2 wherein said rollers are constrained to a certain sector of the ring opposite said insert by suitable pins inserted through said ring and said rollers are rotatably mounted on suitable inserts that closely conform to said rings such that they will not move past said pins, thereby constraining said rollers to roll in the sector in which they are located.

4. The improved apparatus of claim 1 wherein said rings are available in sizes of 4 inch, 6 inch an 1 inch rings and contain respective size rollers of 1.5 inch, 2 inch, and 3 inch rollers; wherein said rings are made of #316 stainless steel, and said rollers are made of thermoplastic with an ultraviolet ray resistance.

5. The apparatus of claim 1 wherein said tack of said spinnaker is attached to the furled headsail.

6. The apparatus of claim 1 wherein each said roller has a central bore which at its minimum diameter closely and conformingly fits the outside diameter of said ring and wherein said central bore has at each end respective frusto-conical bores that allow the roller to rotate in place.

7. The improved apparatus of claim 6 wherein said rollers are formed of thermoplastic material.

* * * * *